US006826877B1

(12) United States Patent
Stradel

(10) Patent No.: US 6,826,877 B1
(45) Date of Patent: Dec. 7, 2004

(54) DOOR FRAME GUARD

(76) Inventor: Jeffrey J. Stradel, 8421 Green St. Rd., Whitelaw, WI (US) 54247

( * ) Notice: Subject to any disclaimer, the term of this patent is extended or adjusted under 35 U.S.C. 154(b) by 274 days.

(21) Appl. No.: 09/636,371

(22) Filed: Aug. 11, 2000

(51) Int. Cl.[7] ..... E06B 1/04
(52) U.S. Cl. ..... 52/211; 52/717.01; 49/462
(58) Field of Search ..... 52/716.1, 211, 52/204.53, 656.4, 717.01, 716.8, 204.1, 213, 217, 656.1, 656.2, 215, 287.1, DIG. 12, 717.05, 800.12, 800.13; 49/57, 462; 248/345.1

(56) References Cited

U.S. PATENT DOCUMENTS 1,803,589 A * 5/1931 Bohnsack
2,209,375 A * 7/1940 Anderson
2,663,390 A * 12/1953 Dordel
2,755,895 A * 7/1956 Walterman et al. ..... 52/211
2,837,787 A * 6/1958 Wright
2,846,868 A * 8/1958 Wedberg
2,862,264 A * 12/1958 Perna ..... 52/287.1
3,046,616 A * 7/1962 Sampsell
3,130,455 A * 4/1964 Borlenghi ..... 52/287.1
3,355,852 A * 12/1967 Lallly
3,452,501 A * 7/1969 Zimmer et al.
3,483,665 A * 12/1969 Miller
3,559,356 A * 2/1971 Koral ..... 52/204
3,566,563 A * 3/1971 Ruff
3,721,055 A * 3/1973 Jerchower
4,443,508 A * 4/1984 Mehl ..... 428/122
4,674,248 A * 6/1987 Hall ..... 52/212
4,698,944 A * 10/1987 Wilkins, Jr. ..... 52/211
4,768,320 A * 9/1988 Weller ..... 52/211
4,873,804 A * 10/1989 Kukke
5,187,909 A * 2/1993 Olson ..... 52/308
5,203,130 A * 4/1993 Freelove ..... 52/211
5,551,189 A * 9/1996 Westfall
5,584,150 A * 12/1996 Newman
5,644,878 A * 7/1997 Wehrmann
5,737,878 A * 4/1998 Raulerson et al.
5,775,045 A * 7/1998 Hill ..... 52/211
5,799,443 A * 9/1998 Koeniguer ..... 49/383
5,815,998 A * 10/1998 Wamsher ..... 52/211
6,076,327 A * 6/2000 Hendrickson
6,357,187 B1 * 3/2002 Haldeman

FOREIGN PATENT DOCUMENTS

GB 2 249 328 A * 5/1992 ..... 52/716

* cited by examiner

*Primary Examiner*—Robert Canfield
(74) *Attorney, Agent, or Firm*—Jon C Gealow

(57) ABSTRACT

The invention provides a removable and reusable door frame guard for a door frame comprising a door jamb, door stop and trim molding attached to a plaster wall. The guard comprises an elongated member having a substantially planar web with depending parallel side panels normal to the planar web. One or both of the side panels terminate with two right angled flanges adaptable for a gripping action with the trim molding and plaster wall. For the hinge side, one side panel has a width about equal to the width of the door stop and about terminates at the jamb, and this narrow panel is adaptable to abut the side of the door stop, as well as the jamb along the marginal edge, thereby providing a gripping action at this side of the guard. Thus, when the guard component is installed over the door frame, the elongated member is adaptable to at least partially engage the door jamb and abut the door stop, and at least one side of the guard is adaptable to grip the trim molding.

7 Claims, 4 Drawing Sheets

DOOR FRAME GUARD

FIELD OF INVENTION

This invention relates to a door frame guard. In its more specific aspect, this invention relates to a door frame guard attachable to the strike side of a door frame or to the hinge side of the door frame.

BACKGROUND AND PRIOR ART

During construction projects or during moving projects, the type of work of necessity is in close proximity to the door, and carrying or passing objects or items through the doorway, or working adjacent to the doorway, can cause damage to the door frame. Typically, a door frame comprises a doorjamb, a stop, and a trim molding affixed to the wood framing, usually of 2"×4" lumber, and plaster dry wall or sheet rock. If the door frame is made of wood, the frame or parts of it can be accidentally scratched, scuffed, split or gouged by the workers, paint splashed on it, or a fixture (e.g., furniture piece) might be accidentally banged into the frame while being moved. Similarly, metal door frames can be dented or chipped by these types of impacts. Damages detract from the appearance or utility of the doorway, and time and money are needed to repair or replace the damaged door frame.

Door frame guards or door frame protectors are known in the art to prevent this type of damage from occurring or to minimize the damage. These door frame guards are intended to be used by commercial and professional workers such as trades people, maintenance professionals, and employees, as well as do-it-yourself home owners. These guards or protectors are installed in place over the door frame, which act as a shield to protect the door frame from damage, and are relatively inexpensive and desirably easy to install and remove, and usually are reusable.

Removable and reusable door frame guards are shown in the prior art. For example, U.S. Pat. No. 5,737,878—Raulerson et al, discloses a U-shaped guard that is attached to the door frame. The guard comprises an elongated, planar wall with inwardly turned side panels to enhance the gripping action, and the guard for the hinge side of the door is provided with a plurality of openings to accommodate the hinges. However, the gripping action of this guard is relatively poor, and the guard is easily knocked off when pumped or hit by a workman or by an item or fixture passing through the doorway. A relatively complicated guard is shown in U.S. Pat. No. 5,203,130—Freelove, which include flange-like cleats that grip the trim molding. These cleats, however, gouge the trim, which defeats the purpose of the guard. A U-shaped guard having a resilient lining is disclosed in U.S. Pat. No. 4,768,320—Weller. The converging end sections grip the trim molding, but the outer edges protrude and any item passing through the doorway can catch the edge and easily snap off the guard. A magnetic door frame guard useful for metal doorways is shown in U.S. Pat. No. 5,775,045—Hill, which therefore has limited use.

This invention has therefore as its purpose to provide a door fame guard that overcomes the disadvantages of the prior art, and exhibits improved gripping action.

Another object of the invention is to provide a door frame guard that is useful for the strike side of the door frame or the hinge side of the door frame.

It is another object of the invention to provide a door frame guard which is easy to install and remove, is reusable, and is cost-effective, and time-saving.

SUMMARY OF THE INVENTION

My invention provides a removable and reusable door frame guard for installation over, and for providing temporary protection to, a door frame comprising a doorjamb, a door stop, and trim molding attached to a plaster dry wall defining a doorway or opening. The guard or protector comprises an elongated member, for vertical and/or horizontal disposition along the door frame, having a substantially planar web with substantially parallel side panels or walls normal to the planar web and depending from the opposed longitudinal edges of the planar web. At least one of the side panels has an inwardly directed shoulder terminating with an outwardly directed transverse flange which parallel the plaster wall when the guard is installed. The shoulder and transverse flange have substantially planar surfaces adaptable for a gripping action or engagement with the trim molding and plaster wall. Thus, when the guard component is installed over the door frame, the elongated member is adaptable to at least partially enclose the door jamb and abut the door stop, and at least one side of the guard is adaptable to grip the trim molding.

In accordance with one embodiment of the invention, one side only of the guard includes the shoulder and transverse flange. This embodiment is utilized for the hinge side of the door frame. For this embodiment, the guard includes the two side panels, but one side panel has a width about equal to the width of the door stop, and includes no shoulder or transverse flange. Thus, this narrow panel terminates at the jamb and abuts the side of the door stop, as well as the jamb along its marginal edge, thereby providing a gripping action at this side of the guard. It will be observed that because the zone of engagement for this one side of the guard is limited to the stop and jamb, and does not extend to the trim molding and plaster wall as on the opposite side of the guard, the door hinges are no obstacle, that is the hinges do not inhibit the installation of the guard, regardless of the number of hinges, and no special design of the guard is required to receive or to accommodate the hinges.

In the alternative embodiment, both sides of the door frame guard are substantially identical, that is the guard is symmetrical as viewed along a transverse plane disposed along the center longitudinal axis of the guard. Thus, both sides include the side panel, shoulder, and transverse flange, and the gripping action is against the trim molding and plaster wall, as explained above.

Preferably, the door frame guard can be made of a suitable plastic, such as polypropylene, a vinyl plastic, or other suitable plastic material. The fabricated guard is sufficiently rigid to be self-sustaining, but because of the design of the guard, the side panels and extensions exhibit some flexibility to facilitate the installation and securement of the guard to the frame. Also, a shorter guard may be provided for the top side of the doorway. It also is preferable to provide the guard with a compressible polymeric lining, such as a rubberized or elastomeric lining, so as to protect the doorway from any abrasive action of the guard.

BRIEF DESCRIPTION OF THE DRAWINGS

The invention and its advantages will be more readily understood by reference to the following detailed description and exemplary embodiments when read in conjunction with the following drawings, wherein.

DETAILED DESCRIPTION OF THE INVENTION AND PREFERRED EMBODIMENTS

Figure 1:
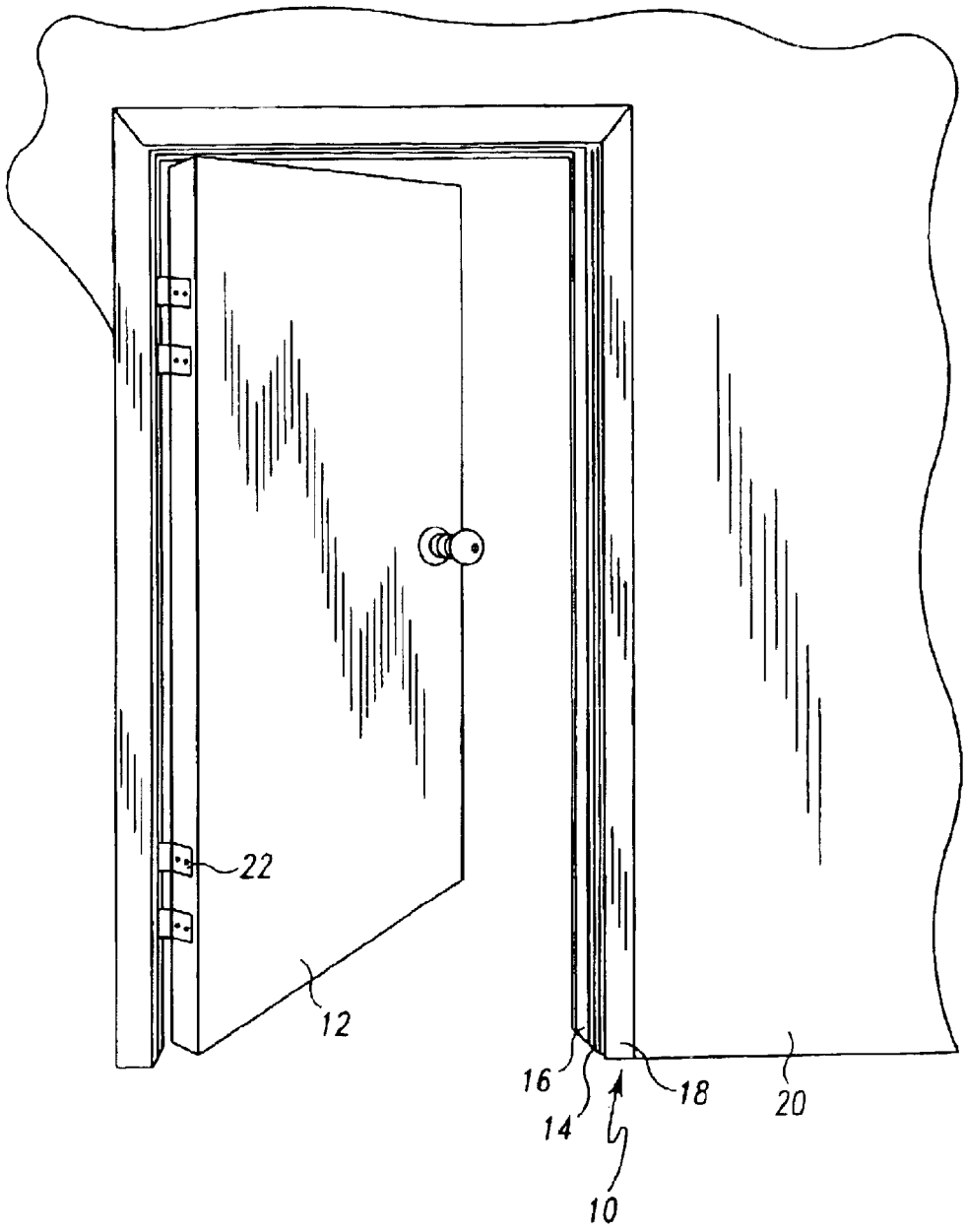
Fig. 1 (Prior Art)
FIG. 1 is a perspective view of a conventional door frame with a hung door in a partial open position.

Referring to the drawings wherein the same reference numerals refer to similar parts throughout the various views, there is shown in FIG. 1 a conventional doorway including a door frame, indicated generally by the numeral 10, and a hung door 12. The door frame is comprised of a jamb 14, door stop 16, and trim molding 18, affixed to the plaster wall or dry wall 20 supported by a wood framing such as 2"×4" lumber 21, and the door frame is typically on both sides and on the top of the doorway. The door stop and trim molding have substantially flat surfaces, and each has opposed marginal edges. One marginal edge for the trim molding is about flush with the doorjamb (see FIGS. 8 and 9) and the opposed marginal edge is outwardly disposed. It should be understood that the doorjamb and stop are typically provided as two separate pieces, but where desired, the two components can be provided as a single unit. The door 12 is hung to the jamb 14 by hinges 22, which is known as the hinge side and the opposite side is known as the strike side. For purposes of my invention, the number of hinges is immaterial, which will be more apparent from the description below.

There is shown in FIGS. 2, 3, 4 and 4A one embodiment of the invention depicting a door frame guard, indicated generally by the numeral 24, for use on the strike side or the top of the doorway. The guard for the strike side of the frame and the top of the frame are the same, except for length, and therefore the description of one is applicable to both. The guard comprises an elongated channel-like member 26 for installation on the door frame 10, and when installed on the strike side of the doorway, the elongated member is in a vertical position, but when above the door way, the guard is in a horizontal position. The elongated member, preferably formed of a plastic, includes a planar web or wall 28 which, upon installation, runs parallel with the door jamb 14. The planar web has parallel side panels 32 and 34 extending normal to the web at the longitudinal edges of the web, thereby defining a channel-like configuration 36 (see FIGS. 4 and 4A) for enclosing the door jamb, stop and trim when the guard is installed. Each panel terminates with two right angled flanges 38 and 40 forming an inwardly directed shoulder having an extension or rib outwardly directed relative to the channel 36. It will be observed that the flange 40 (i.e., the extension) is substantially parallel with the face of the plaster wall and therefore the two right angled flanges 38 and 40 are adaptable for seating on the marginal edge of the trim molding when the guard is installed.

Figure 7:
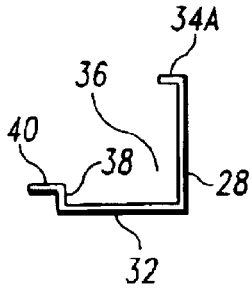
FIG. 7 is a top view of the embodiment of the door frame guard shown in FIG. 6.
Figure 7A:
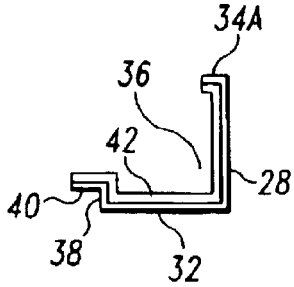
FIG. 7A is similar to FIG. 7, but showing a rubberized lining for the door frame guard.

It is preferable to provide the guard with an inner lining 42, which protects the door frame from any abrasion that might be caused by the guard when installed. (See FIGS. 4A and 7A.) This lining may be a compressible polymer, such as an elastomeric or rubberized foam, or a closed cell cellular polymer which is substantially moisture resistant, and may be applied to the inside of the guard with a suitable adhesive, which are commercially available. The polymer lining may be, for example, sponge rubber, polyethylene foam, or silicone rubber sponge. Also, the lining is compressible, and enhances the gripping action of the guard to the door frame, as explained in more detail below.

There is shown in FIGS. 5, 6, 7, and 7A a modified form of the door frame guard for the hinge side of the door. As described above for the other embodiment of the invention showing a guard for the strike side, the guard is symmetrical when viewed in longitudinal cross-section. However, a symmetrical form for the guard is not feasible for the hinge side because the hinges would prevent the side panels from extending over the trim molding. In accordance with this modified form of the guard, one side panel 34A terminates at about the doorjamb 14, and panel 34A, which is about the width of a typical door stop, is adjacent to and abuts the marginal edge of the door stop 16. It thus will be observed that the door frame guard for this modified embodiment is asymmetrical as viewed in longitudinal cross-section in that panel 34A is substantially narrower than panel 32. When installed, the terminal edge of panel 34A abuts the doorjamb, and the panel 34A engages the door stop, thereby providing a gripping action. This gripping action, in combination with the gripping action established on the opposite side, provides a film grip or hold of the guard on the door frame.

Figure 2:
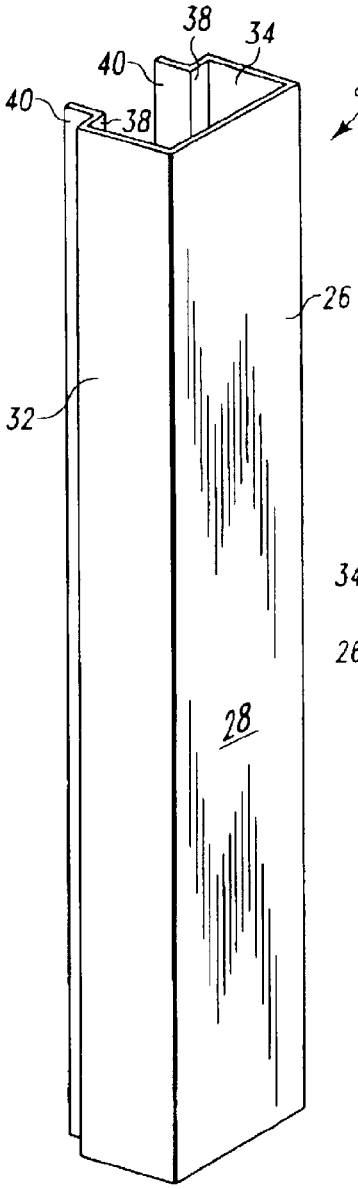
FIG. 2 is a perspective view from the front side of the door frame guard embodying the features of the invention
Figure 3:
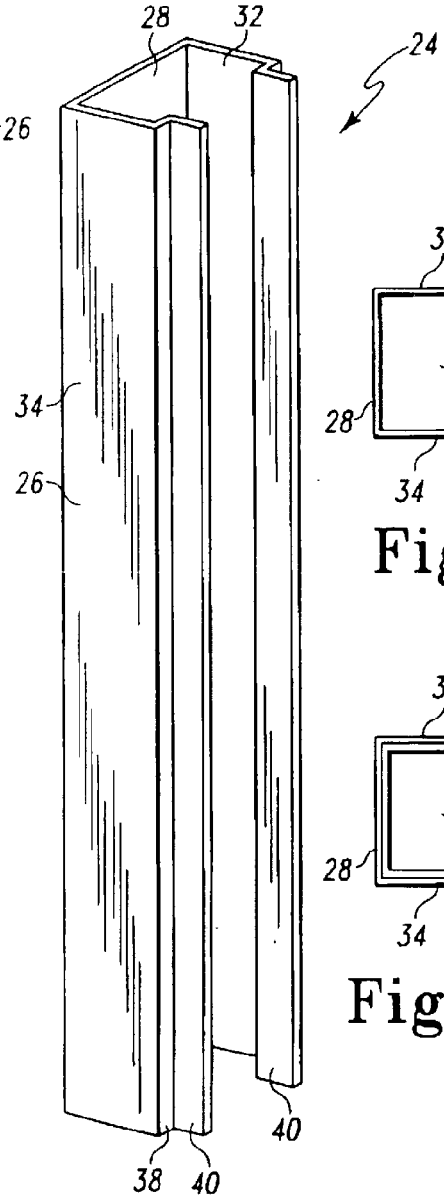
FIG. 3 is a view similar to FIG. 2 but viewing the door frame guard from the back
Figure 4:
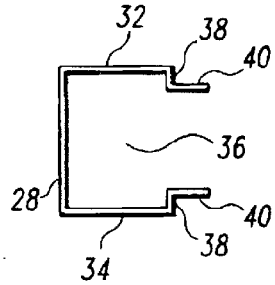
FIG. 4 is a top view of the door frame guard of FIG. 2 and FIG. 3
Figure 4A:
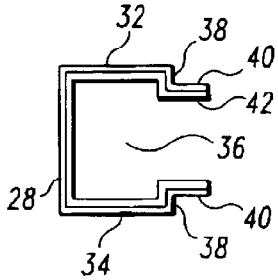
FIG. 4A is similar to FIG. 4, but showing a rubberized lining for the door frame guard.
Figure 5:
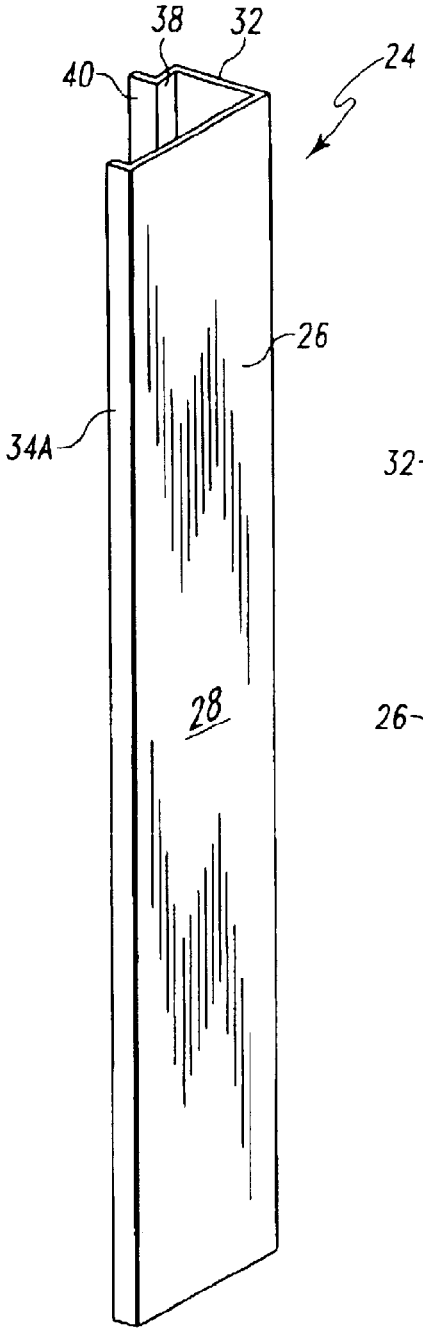
FIG. 5 is a perspective view from the front side of a modified door frame guard falling within the scope of the invention for the hinge side of the door.
Figure 6:
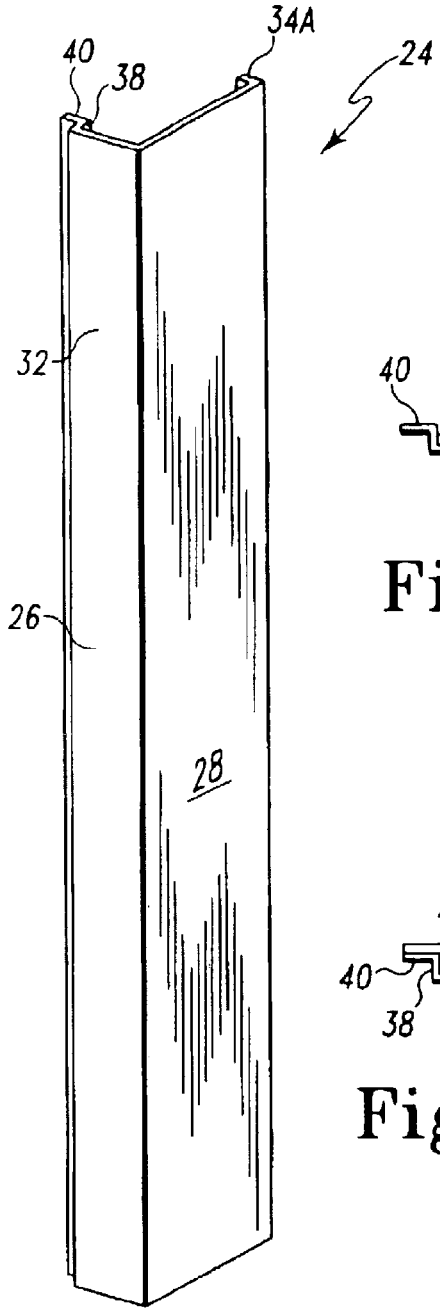
FIG. 6 is a view similar to FIG. 5 but viewing the door frame guard from the opposite side.
Figure 8:
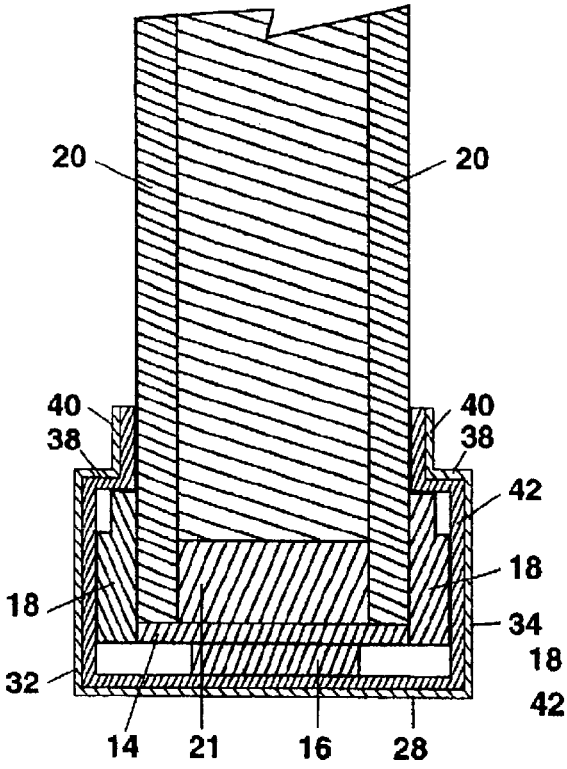
FIG. 8 is a fragmentary, sectional view of the door frame guard of FIG. 2 showing the installed guard on the strike side of a door frame attached to a wall.
Figure 9:
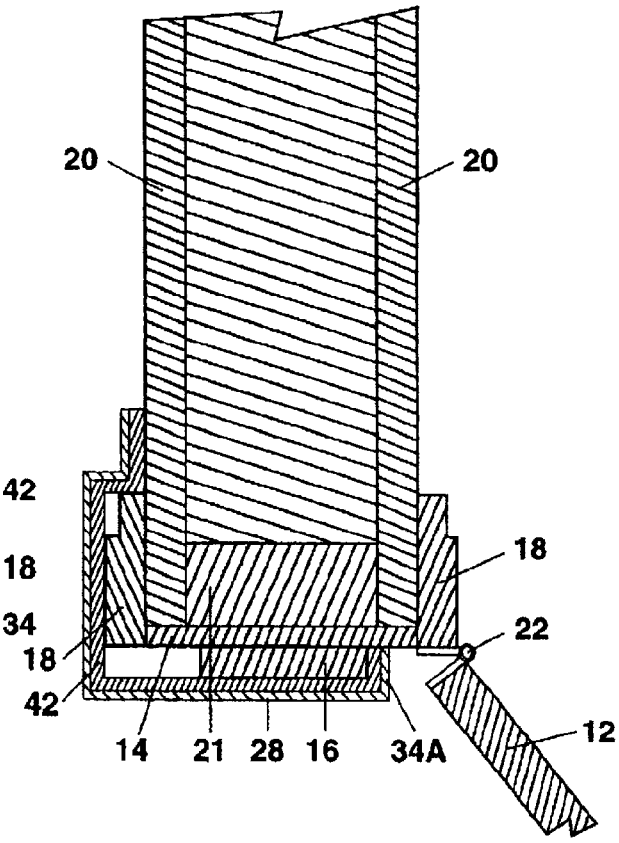
FIG. 9 is a fragmentary, sectional view of the door frame guard of FIG. 5 showing the installed guard on the hinge side of a door frame attached to a wail.

FIGS. 8 and 9 show the door frame guard 24 installed on the door frame. In FIG. 8, the door frame guard is for the strike side, which embodiment is shown in FIGS. 2 and 3. It will be observed that when the guard is installed, the planar web 28 abuts the door stop 16, the side panels 32 and 34 abut the trim molding, and the right angled flanges 38 and 40 seat on the marginal edge of the trim molding and abut the dry wall 28. As explained above, the griping action of the guard is the same on both sides, and because the panel is formed of a flexible material, the guard remains in place. When the task at hand is finished (e.g., furniture moving, construction, painting), the guard can be removed easily and reused.

In FIG. 9, the guard is for the hinge side, which differs from the other embodiment only in that one side panel 34A is narrow, as explained above. Thus, when the guard is installed, one side of the guard is gripped in place by panel 32 and the right angled flanges 38 and 40, and the front web overlies the facing of the stop. The opposite side of the guard is gripped in place by the narrow panel 34A abutting the door stop. Thus, the elongated door guard 24 partially enclosed the doorjamb 14. The panel 34A does not extend to the trim molding 18 because of the hinges 22. As a consequence, the number of hinges, the size of the hinges, or the placement of the hinges are no obstacle in installing the door frame guard on the hinge side.

By reason of the invention, numerous advantages are achieved. The door frame guard of my invention is versatile in that it can fit the strike side, the top, and the hinge side of the door frame. Further, the size or number of hinges are irrelevant. In addition, the door frame guard is relatively inexpensive, easy to install and remove, and is reusable. In addition, it should be understood that the foregoing detailed description has been given for clearness of understand only, and no unnecessary limitations should be understood therefrom, as modifications will be obvious to those skilled in the art

What is claim is:

1. In combination with a door frame having a door jamb, a door stop protruding from the doorjamb and having opposed marginal edges, and trim molding attached to the exposed face of a wall, a removable and reusable guard for providing temporary protection to the door frame comprising:

(a) an elongated member having a substantially planar web with substantially parallel side panels normal to said planar web and depending from the opposed longitudinal edges of said planar web thereby defining a channel adaptable to receive at least a portion of the door frame, said planar web extending generally parallel to the door jamb and adjacent to the door stop, and said parallel side panels extending generally parallel to and engaging the trim molding; said side panels being flexible with respect to each other, such that said channel may be spread to install said door frame guard, and said side panels flexing toward each other to engage the trim molding;

(b) at least one of said side panels having an inwardly directed shoulder terminating with a transverse flange and adaptable for seating on the marginal edge of the trim molding and abutting the face of the wall, said side panels flexing toward each other to provide a gripping action with the trim molding and wall, whereby said elongated member is adaptable to enclose at least partially the door jamb and abut the door stop.

2. In combination with a door frame having a door jamb, door stop, and trim molding attached to the exposed faces of opposed walls, a removable and reusable door frame guard for providing temporary protection to the door frame comprising:

(a) an elongated member having a substantially planar web with parallel side panels normal to said planar web and depending from the opposed longitudinal edges of said planar web, thereby defining a channel said side panels being flexible with respect to each other;

(b) each of said side panels extending over the trim molding and having an inwardly directed shoulder terminating with a transverse flange and adaptable for seating on the marginal edge of said trim molding and abutting the face of the wall, said side panels flexing toward each other to provide a gripping action with the trim molding and wall, whereby said elongated member being adaptable to enclose the door frame and abut the door stop.

3. In combination with a door frame having a door jamb, a door stop protruding from the doorjamb and having opposed marginal edges, and trim molding attached to a wall, a removable and reusable door frame guard comprising:

(a) an elongated member having a substantially planar web with substantially parallel side panels normal to said planar web and depending from the opposed longitudinal edges of said planar web thereby defining a channel, said side panels being flexible with respect to each other;

(b) one of said side panels having an inwardly directed shoulder terminating with a transverse flange; (c) said shoulder and said flange adaptable for gripping action with the trim molding and wall as said side panels are flexed toward each other; (d) the other of said side panels adaptable to terminate at about the door jamb and engage a marginal edge of the door stop for providing a gripping action with the door stop as said side panels are flexed toward each other; whereby said elongated member is adaptable to at least partially enclose the doorjamb and abut the door stop.

4. The combination according to any one of claims 1–3 wherein said guard is made of plastic.

5. The combination according to any one of claims 1–3 wherein said guard includes a compressible polymer lining.

6. The combination according to claims 5 wherein said lining is a closed cell polymer.

7. The combination according to claim 5 wherein said lining is an open cell polymer.

* * * * *